US008971741B2

(12) United States Patent
Mitsunobu

(10) Patent No.: US 8,971,741 B2
(45) Date of Patent: Mar. 3, 2015

(54) IMAGE FORMING DEVICE

(71) Applicant: Oki Data Corporation, Tokyo (JP)

(72) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 22 days.

(21) Appl. No.: 13/949,882

(22) Filed: Jul. 24, 2013

(65) Prior Publication Data

US 2014/0037311 A1 Feb. 6, 2014

(30) Foreign Application Priority Data

Aug. 2, 2012 (JP) ..... 2012-172049

(51) Int. Cl.
*G03G 15/08* (2006.01)
*G03G 15/01* (2006.01)
*G03G 15/00* (2006.01)

(52) U.S. Cl.
CPC ..... *G03G 15/0121* (2013.01); *G03G 15/6585* (2013.01); *G03G 2215/0141* (2013.01)
USPC ..... 399/53; 399/50; 399/51; 399/55

(58) Field of Classification Search
USPC ..... 399/53, 46, 55, 50, 51
See application file for complete search history.

(56) References Cited

U.S. PATENT DOCUMENTS 4,847,658 A * 7/1989 Takebe et al. ..... 399/54
4,897,331 A * 1/1990 Toyoshi et al. ..... 430/100
5,077,158 A * 12/1991 Nakano ..... 430/123.56
5,113,221 A * 5/1992 Kotani et al. ..... 399/54
5,915,144 A * 6/1999 Ide et al. ..... 430/45.3
7,853,177 B2 * 12/2010 Bae ..... 399/149
2008/0138121 A1 * 6/2008 Tamaki ..... 399/302
2008/0152389 A1 * 6/2008 Kim ..... 399/223
2008/0152397 A1 * 6/2008 Bae ..... 399/298
2008/0153017 A1 * 6/2008 Park et al. ..... 430/48
2008/0159787 A1 * 7/2008 Lee et al. ..... 399/223

FOREIGN PATENT DOCUMENTS

JP 2007-083634 A 4/2007

* cited by examiner

*Primary Examiner* — G. M. Hyder
(74) *Attorney, Agent, or Firm* — Muncy, Geissler, Olds & Lowe, P.C.

(57) ABSTRACT

An image forming device includes each of developing devices including an image carrying part, a charging part that charges the image carrying part, a developing part on which a developing voltage is applied and which attaches developer to the image carrying part to develop the electrostatic latent image, and a control part that controls each of the developing devices. The developers are a white developer and other color developers, one of the developing devices using the white developer being defined the white developing device, the others using the other color developers being defined the non-white developing devices, and a developing potential difference of the white developing device is smaller than other developing potential differences of the non-white developing devices, the developing potential difference being defined between the developing voltage and potential of the image carrying part of the each developing device.

13 Claims, 15 Drawing Sheets

Fig. 5

| | Cyan (c) | Yellow (y) | Magenta (m) | White (w) |
|---|---|---|---|---|
| Developing Vol. DB [V] | −200 | −200 | −200 | −200 |
| Charging Vol. CH [V] | −1200 | −1200 | −1200 | −1000 |
| Supply Vol. SB [V] | −300 | −300 | −300 | −400 |
| Transfer Vol. TR [V] | +4000 | +4000 | +4000 | +4000 |
| Light Emission Time TL | 0% | 0% | 0% | −40% |
| Drum Surf. Potential DS2 [V] (Potential of Exp. Part OPC) | −50 | −50 | −50 | −50 |
| Drum Surf. Potential DS1 [V] (Potential of Non-Exp. Part OPC) | −600 | −600 | −600 | −400 |

Fig. 10

| | Cyan (c) | Yellow (y) | Magenta (m) | White (w) |
|---|---|---|---|---|
| Developing Vol. DB [V] | −200 | −200 | −200 | −400 |
| Charging Vol. CH [V] | −1300 | −1300 | −1300 | −1300 |
| Supply Vol. SB [V] | −300 | −300 | −300 | −600 |
| Transfer Vol. TR [V] | +6000 | +6000 | +6000 | +6000 |
| Light Emission Time TL | +20% | +20% | +20% | −20% |
| Drum Surf. Potential DS2 [V] (Potential of Exp. Part OPC) | −50 | −50 | −50 | −250 |
| Drum Surf. Potential DS1 [V] (Potential of Non-Exp. Part OPC) | −700 | −700 | −700 | −700 |

IMAGE FORMING DEVICE

CROSS REFERENCE TO RELATED APPLICATION

The present application is related to, claims priority from and incorporates by reference Japanese Patent Application No. 2012-1702049, filed on Aug. 2, 2012.

TECHNICAL FIELD

The present invention relates to an image forming device and can be applied to an electrophotographic printer, copier, and the like.

BACKGROUND

Conventionally, in an electrophotographic printer, when performing image formation on a translucent print medium, there is a case where a white toner is used. The translucent print medium corresponds to, for example, a film used with an OHP (overhead projector) (referred to as an "OHP film" in the following). Conventionally, as an image forming device that performs image formation using a white toner on an OHP film, there is a technology described in JP2007-083634A.

In the image forming device described in JP2007-083634A, when printing a color image on an OHP film and the like, in order to improve printing quality (image printing quality), a corresponding image is printed using a white toner on a surface opposite to a surface on which a color image is printed.

However, in a conventional image forming device, when performing image formation using a white toner, printing quality may deteriorate.

Therefore, an image forming device that can suppress deterioration of image formation quality due to characteristics of a developer is desired.

SUMMARY

An image forming device of the present invention includes (1) one or a plurality of developing devices, and (2) a control part. Each of the developing devices includes an image carrying part carrying an electrostatic latent image; a developing part on which a developing voltage is applied and which attaches developer to the image carrying part to develop the electrostatic latent image; and a charging part charging the image carrying part. The control part controls for each of the developing devices a developing potential difference between the developing voltage and potential of the image carrying part in such a manner that the developing potential difference of a developing device using a white developer is smaller than the developing potential difference of a developing device using a developer of other colors other than the white developer.

According to the embodiments of the present invention, deterioration of image quality can be reduced.

BRIEF DESCRIPTION OF THE DRAWINGS

FIG. 5 is an explanatory diagram illustrating an example of content of a first setting table used in the image forming device according to the first embodiment.

FIG. 10 is an explanatory diagram illustrating an example of content of a second setting table used in the image forming device according to the second embodiment.

DETAILED DESCRIPTION OF THE EMBODIMENTS

(A) First Embodiment

In the following, a first embodiment of an image forming device according to the present invention is explained with reference to the drawings.

(A-1) Configuration of First Embodiment

First, an overall configuration of an image forming device 1 of the first embodiment is explained.

Figure 2:
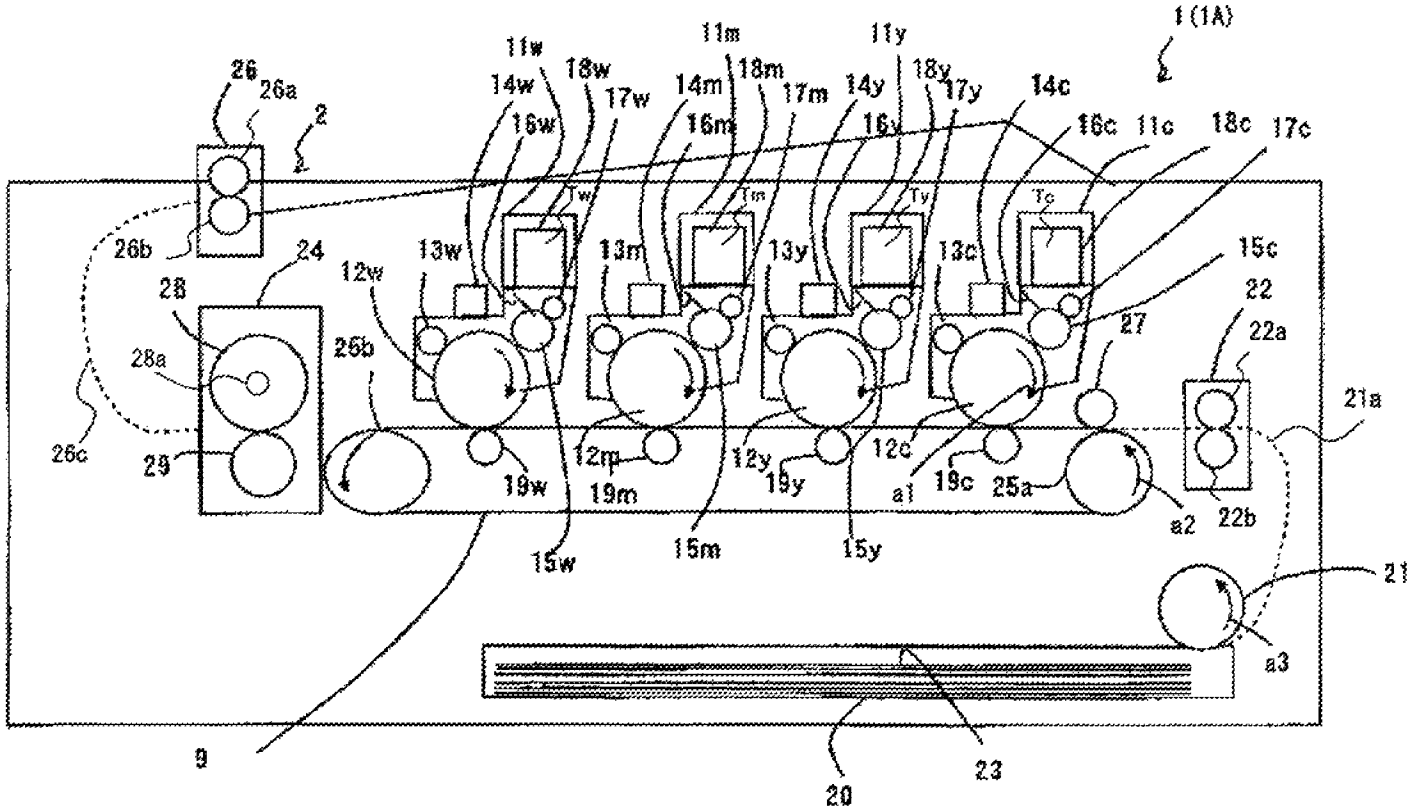
FIG. 2 is a schematic cross-sectional view of the image forming device according to the first embodiment.

FIG. 2 is a schematic cross-sectional view of the image forming device 1 of this embodiment.

The image forming device 1, for example, is an electrophotographic color image forming device and is capable of image formation using four toner colors of cyan (hereafter, may be referred to as "c"), yellow (hereafter, may be referred to as "y"), magenta (hereafter, may be referred as "m") and white (hereafter, may be referred to as "w") on a print medium 23 as a medium.

The image forming device 1 performs image formation on the print medium 23 using toner T (Tc, Ty, Tm, Tw) as a developer of each toner color. In the first embodiment, as the print medium 23, for example, an OHP film, a transfer paper, a colored plain paper, and the like, can be used. The transfer paper, for example, is what is used as a medium for transferring an image to a cloth such as a T-shirt. By applying a print side of the transfer paper, on which toner is transferred, to the cloth and by heating and pressurizing with an iron and the like from a back side (opposite to the print side) of the transfer paper, the image of the transfer paper can be transferred to the cloth. The colored plain paper is a plain paper colored with a color other than white (for example, a paper of a color of black, blue, red, and the like).

The image forming device 1 has a developing device 11 (11*c*, 11*y*, 11*m*, 11*w*) for each toner color, an LED head 14 (14*c*, 14*y*, 14*m*, 14*w*) as an exposure part for forming an electrostatic latent image of each toner color, and a toner tank 18 (18*c*, 18*y*, 18*m*, 18*w*) as a developer storage part of each toner color.

The developing device 11 (11*c*, 11*y*, 11*m*, 11*w*) of each toner color has a charging roller 13 (13*c*, 13*y*, 13*m*, 13*w*) as a charging part, a supply roller 17 (17*c*, 17*y*, 17*m*, 17*w*) as a supply part, a developing roller 15 (15*c*, 15*y*, 15*m*, 15*w*) as a developing part, a layer forming blade 16 (16*c*, 16*y*, 16*m*, 16*w*), and a photosensitive drum 12 (12*c*, 12*y*, 12*m*, 12*w*) as an image carrying part.

The developing device 11 of each toner color is uniformly charged by the charging roller 13 that is in contact with the photosensitive drum 12. An electrostatic latent image is formed by exposure by each LED head 14 on each photosensitive drum 12 that is charged. Each supply roller 17 supplies toner as a developer to each developing roller 15. It is configured that when each layer forming blade 16 uniformly forms a toner layer on a surface of each developing roller 15, a toner image is developed on each photosensitive drum 12. The toner tank 18 (18*c*, 18*y*, 18*m*, 18*w*) of each toner color stores each toner T (Tc, Ty, Tm, Tw) as a developer, is detachably attached in each developing device 11, and is configured to supply the stored toner to each developing device 11.

Below each developing device 11, a transfer roller 19 (19*c*, 19*y*, 19*m*, 19*w*) as a transfer part of each toner color, a transfer belt driving roller 25*b*, and a transfer belt driven roller 25*a* are provided. Each transfer roller 19 is arranged capable of applying a bias voltage from a back surface of a transfer belt 9 to a transfer position. The transfer belt driving roller 25*b* and the transfer belt driven roller 25*a* extend and support the transfer belt 9 in a tensioned state and are configured capable of conveying the print medium 23 by the driving of the transfer belt driving roller 25*b*.

Below the transfer belt 9, a paper cassette 20 is detachably attached. In the paper cassette 20, the print media 23 are loaded.

Between a front end of the paper cassette 20 (an end on a downstream side of medium conveyance) and the transfer belt driving roller 25*b*, a paper feed roller 21, a paper guide 21*a*, and a conveying roller unit 22 (having a pair of conveying rollers 22*a*, 22*b*) that pulls out the print medium 23 from the paper guide 21*a* are arranged. Above the transfer belt 9, an adsorption roller 27 for adsorbing the print medium 23 on the transfer belt 9 (for bringing the print medium 23 into contact with the transfer belt 9) is arranged at a position opposing the transfer belt driven roller 25*a*.

The paper feed roller 21 separates and takes out the print medium 23 one by one from the paper cassette 20 and feeds the print medium 23 to the paper guide 21*a*. The fed print medium 23 is conveyed along the paper guide 21*a* and is pulled out by the conveying roller unit 22 (the pair of the conveying rollers 22*a*, 22*b*). The print medium 23 that is pulled out by the conveying roller unit 22 is supplied to a transfer belt 9 side. The print medium 23 that is supplied from the conveying roller unit 22 to the transfer belt 9 is sandwiched on the transfer belt 9 between the adsorption roller 27 and the transfer belt driven roller 25*a*. Then, the print medium 23 is adsorbed on the transfer belt 9.

On a downstream side of medium conveyance of the transfer belt 9, a fixing unit 24 is provided. The fixing unit 24 has a heating roller 28 inside which a heating body 28*a* (such as a halogen lamp) is arranged, and a pressing roller 29. In the fixing unit 24, the print medium 23 is sandwiched between the heating roller 28, which is heated by the heating body 28*a*, and the pressing roller 29, and is conveyed to a downstream side of medium conveyance while being heated and pressed.

On a further downstream side of the fixing unit 24, a paper guide 26*c*, a eject roller unit 26 (a pair of eject rollers 26*a*, 26*b*), and an output tray 2 are arranged. The print medium 23 that is supplied from the fixing unit 24 to the paper guide 26*c* is ejected by the eject roller unit 26 (the pair of eject rollers 26*a*, 26*b*) and is placed on the output tray 2.

Next, a material of the toner T (Tc, Ty, Tm, Tw) stored in each toner tank 18 (18*c*, 18*y*, 18*m*, 18*w*) is explained.

In the first embodiment, the toner T (Tc, Ty, Tm, Tw) of each toner color is composed of a polyester resin, a colorant, a charge control agent and a release agent, has an external additive (hydrophobic silica) added thereto, and uses a developer of a ground shape having an average particle size of 8 μm that is obtained by using a grinding method. As the toner T (Tc, Ty, Tm, Tw), a toner obtained by other commonly known method such as a polymerization method may also be used.

Further, in the first embodiment, as the colorant of the white toner Tw (white developer), titanium dioxide is used. As the colorant used for the toner Tw, a material such that an opaque toner image is obtained is desirable. In this respect, titanium dioxide is a preferred material. As the colorant of the white toner Tw, metal oxide other than titanium dioxide (such as aluminum oxide, barium sulfate, and zinc oxide) may also be used.

Further, as the colorants for the toners Tc, Ty, Tm of colors other than white (developers of other colors, or non-white developers), commonly known colorants (pigments) such as pigment cyan, pigment magenta and pigment yellow are respectively used. Further, for the toners Tc, Ty, Tm of colors other than white, pigments of colors that are transparent to some extent may also be used as colorants.

As described above, in the first embodiment, only the white toner Tw has different electrical characteristics such as charging characteristics. For example, an experiment is performed in which the white toner Tw used in the first embodiment and the toners Tc, Ty, Tm of colors other than white are charged under the same condition and the white toner Tw has a less charge amount. Specifically, the white toner Tw and the toners Tc, Ty, Tm of colors other than white are attached to a roller to which a same bias voltage is applied, and charge amounts of the toners are measured using a charge amount measuring device (Suction Type Small Charge Amount Measuring Device Model 212HS, by TREK JAPAN KK). As a result, the charge amount of the white toner Tw is −6 μC/g and the charge amounts of the toners Tc, Ty, Tm of colors other than white are −30 μC/g. Therefore, the charge amount of the white toner Tw used in this embodiment is found to have a higher conductivity and a property of being difficult to be charged than the toners Tc, Ty, Tm of colors other than white.

Figure 3:
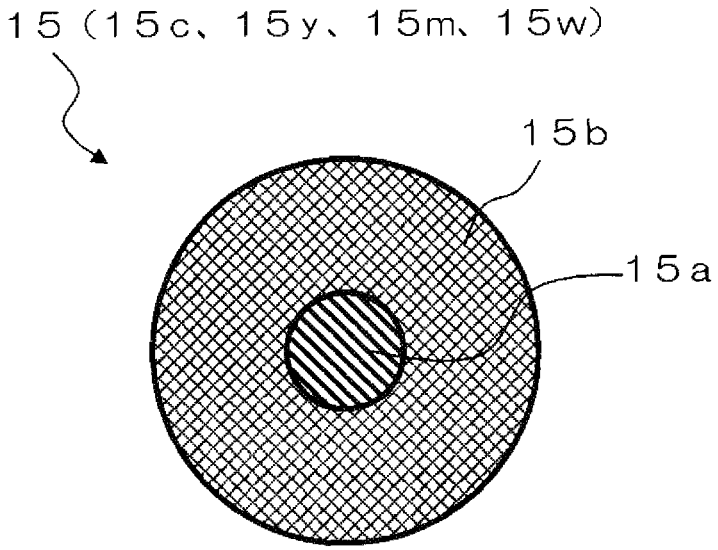
FIG. 3 is a cross-sectional view of a developing roller used in a developing device according to the first embodiment.

Next, a configuration of each developing roller 15 (15*c*, 15*y*, 15*m*, 15*w*) is explained. FIG. 3 is cross-sectional view of each developing roller 15 (15*c*, 15*y*, 15*m*, 15*w*).

As illustrated in FIG. 3, each developing roller 15 (15*c*, 15*y*, 15*m*, 15*w*) of the first embodiment has an elastic layer 15*b* formed around a metallic shaft 15*a*, the elastic layer 15*b* being made of an elastic body. As the elastic layer 15*b*, for example, a semiconductive urethane rubber of a rubber hardness of 700 (Asker C hardness) can be used.

Figure 4:
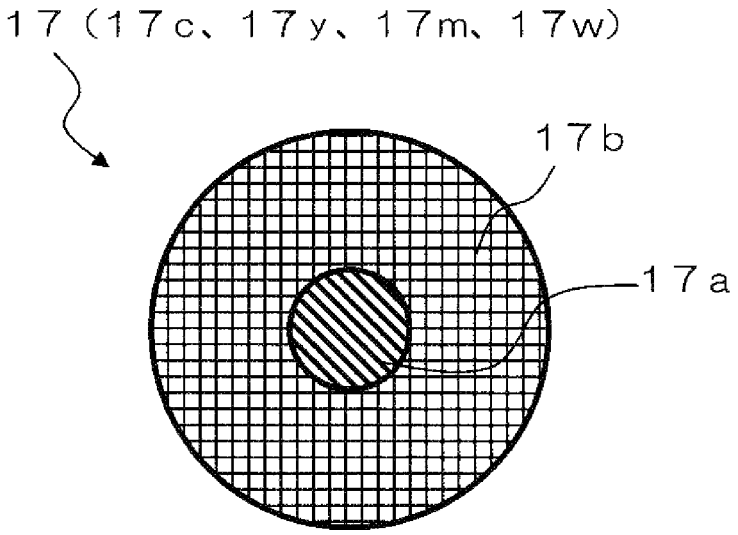
FIG. 4 is a cross-sectional view of a supply roller used in the developing device according to the first embodiment.

Next, a configuration of each supply roller 17 (17*c*, 17*y*, 17*m*, 17*w*) is explained. FIG. 4 is a cross-sectional view of each supply roller 17 (17*c*, 17*y*, 17*m*, 17*w*).

As illustrated in FIG. 4, each supply roller 17 (17*c*, 17*y*, 17*m*, 17*w*) of the first embodiment has a foam layer 17*b* formed around a metallic shaft 17*a*, the foam layer 17*b* being made of foam. As the foam layer 17*b*, for example, a silicon foam of a hardness of 500 (Asker F hardness) can be used.

Figure 1:
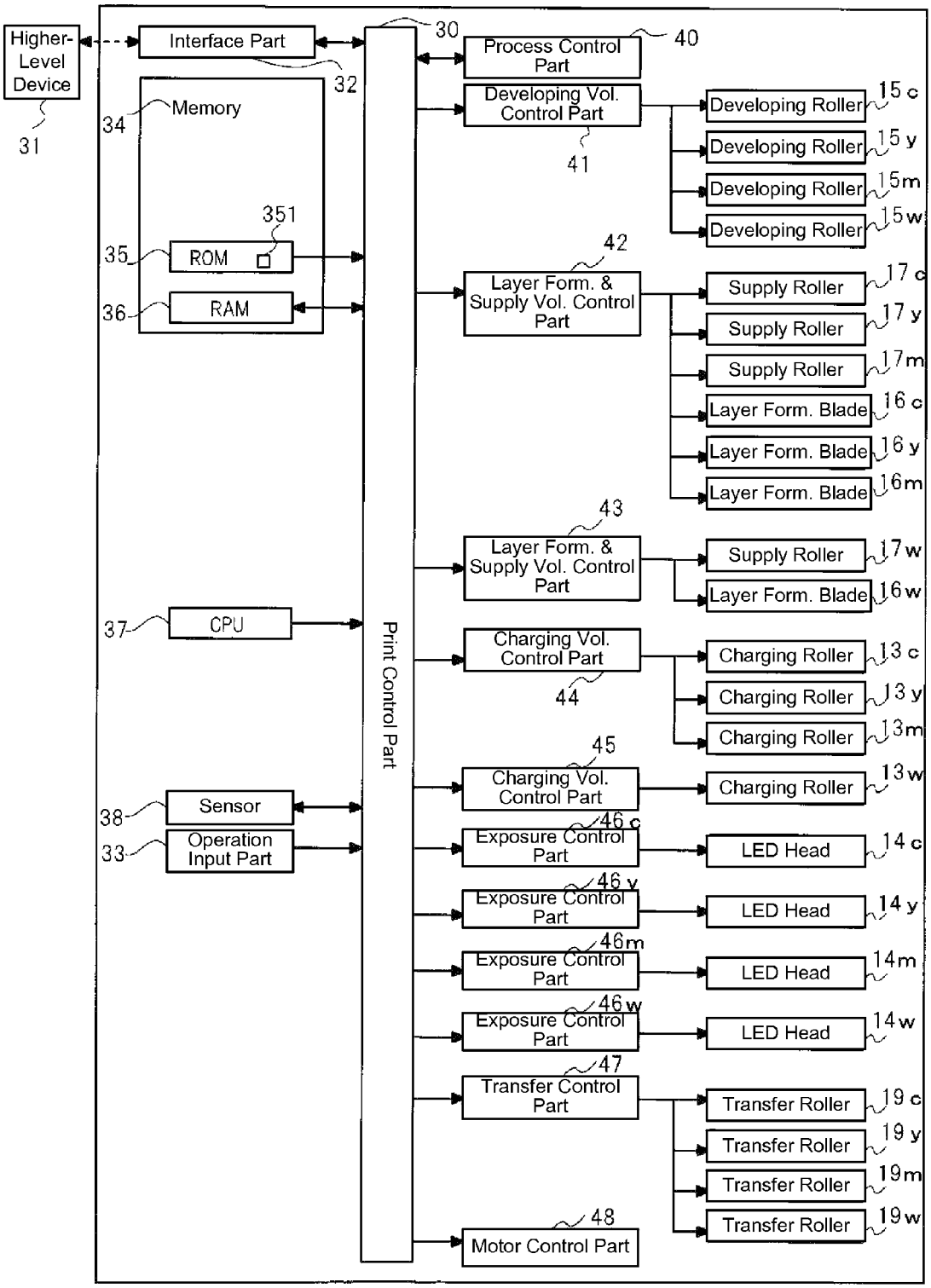
FIG. 1 is a block diagram illustrating a configuration (functional configuration) of a control system of an image forming device according to a first embodiment.

Next, a configuration of a control system of the image forming device 1 is explained using FIG. 1.

As illustrated in FIG. 1, the image forming device 1 has, as a configuration for controlling and driving the configuration elements illustrated in FIG. 2, a print control part 30 (control means) that performs central control processing. An interface part 32, an operation input part 33, a memory 34, a CPU 37, a sensor 38, a process control part 40, a developing voltage control part 41, two layer formation and supply voltage control parts 42, 43, two charging voltage control parts 44, 45, exposure control parts 46 (46*c*, 46*y*, 46*m*, 46*w*) for performing exposure control of the LED heads 14 (14*c*, 14*y*, 14*m*, 14*w*) of the toner colors, a transfer control part 47, and a motor control part 48 are connected to the print control part 30.

The interface part 32 functions as an interface with a higher-level device 31 (for example, a supplier of print data, such as a PC) as an information input means. For example, when print data described in PDL (Page Description Language) and the like is supplied from the higher-level device 31, the interface part 32 transfers the print data to the print control part 30.

The memory 34 includes a RAM 36 (volatile memory) that is used as a working memory and the like and a ROM 35 (non-volatile memory) that stores various setting data (such as parameters used for controlling the configuration elements) and programs (for example, programs that are executed by the CPU 37 and the like). The ROM 35 may be as a data-rewritable EEPROM.

A setting table 351 is stored in the ROM 35. The setting table 351 is used to define parameters that are used when controlling the configuration elements of the print control part 30. Details of the setting table 351 will be described later.

The sensor 38 is used to detect the print medium 23 at a predetermined position on the medium conveyance path illustrated in FIG. 2. When the print medium 23 is detected, the sensor 38 supplies a signal indicating the detection to the print control part 30.

Based on the control of the print control part 30, the process control part 40 performs processing such as management of voltages of rollers illustrated in FIG. 1.

The developing voltage control part 41 as a developing bias application means functions to apply a bias voltage (developing bias voltage) to the charging roller 13 (13*c*, 13*y*, 13*m*, 13*w*) of each toner color. In the following, the bias voltage applied to the charging roller 13 may also be referred to as the "developing voltage DB."

The layer formation and supply voltage control part 42 as a supply bias application means functions to apply bias voltages (supply bias voltages) to the supply rollers 17*c*, 17*y*, 17*m*, and the layer forming blades 16*c*, 16*y*, 16*m*. Further, the layer formation and supply voltage control part 43 functions to apply bias voltages to the supply roller 17*w* and the layer forming blade 16*w*. In the following, the bias voltages applied to the supply roller 17 and layer forming blade 16 may also be referred to as the "supply voltages SB."

The charging voltage control part 44 as a charging bias application means functions to apply bias voltages (charging bias voltages) to the charging rollers 13*c*, 13*y*, 13*m*. In the following, the bias voltage applied to the charging roller 13 may also be referred to as the "charging voltage CH."

The exposure control part 46 (46*c*, 46*y*, 46*m*, 46*w*) of each toner color functions to perform exposure control (light emission control) of the LED head 14 (14*c*, 14*y*, 14*m*, 14*w*).

The transfer control part 47 as a transfer bias application means functions to apply a bias voltage (transfer bias voltage) to the transfer roller 19 (19*c*, 19*y*, 19*m*, 19*w*) of each toner color. In the following, the bias voltage applied to the charging roller 13 may also be referred to as the "transfer voltage TR."

The motor control part 48 functions to control and rotationally drive each motor in the image forming device 1. Specifically, the motor control part 48 controls and rotationally drives motors of the photosensitive drums 12 (12*c*, 12*y*, 12*m*, 12*w*), the paper feed roller 21, the conveying roller unit 22, the driving rollers 25*a*, 25*b* for the transfer belt 9, the adsorption roller 24, the heating roller 28, the pressing roller 29, the eject roller unit 26 and the like.

Each photosensitive drum 12 (12*c*, 12*y*, 12*m*, 12*w*) is rotationally driven in a direction of an arrow a1 (see FIG. 2) by a photosensitive drum motor (not illustrated in the drawing). Further, each photosensitive drum 12 (12*c*, 12*y*, 12*m*, 12*w*) has a gear (not illustrated in the drawing) arranged at one end portion of the corresponding developing roller 15 (15*c*, 15*y*, 15*m*, 15*w*) and supply roller 17 (17*c*, 17*y*, 17*m*, 17*w*). The developing rollers 15*c*, 15*y*, 15*m*, 15*w* and the supply rollers 17*c*, 17*y*, 17*m*, 17*w* are rotationally driven by respectively engaging the gears of the photosensitive drums 12*c*, 12*y*, 12*m*, 12*w*. In the present invention, one of the photosensitive drum 12*w* for which the white toner is used is a white developing device. The other photosensitive drums (12*c*, 12*y*, 12*m*) for which the non-white toners are used are non-white developing devices.

Next, the setting table 351 is explained in detail. In the first embodiment, content of the setting table 351 is defined as illustrated in FIG. 5.

In the setting table 351, corresponding parameters are defined for each toner color. In the setting table 351 illustrated in FIG. 5, the parameters related to the toner of one color are defined in one column. In the setting table 351 illustrated in FIG. 5, for each toner color, parameters including the developing voltage DB, the charging voltage CH, the supply voltage SB, the transfer voltage TR, a light emission time TL, and drum surface potentials DS1, DS2 are set.

In the following, by that a voltage, potential or potential difference is reduced (decreased), it means that the absolute value (output amount) of the voltage, potential or potential difference is made small. Conversely, by that a voltage, potential or potential difference is made high (is increased), it means that the absolute value (output amount) of the voltage, potential or potential difference is made large.

Items of the "developing voltage DB" respectively illustrate bias voltages applied to the charging rollers 13 (13*c*, 13*y*, 13*m*, 13*w*). The items of the developing voltage DB in the setting table 351 illustrated in FIG. 5 are set to be −200 V for all of the toner colors (c, m, y, w).

Items of the "charging voltage CH" respectively illustrate bias voltages applied to the charging rollers 13 (13*c*, 13*y*, 13*m*, 13*w*). The items of the charging voltage CH in the setting table 351 illustrated in FIG. 5 are set to be −1200 V for the toner colors (c, m, y) other than white and −1000 V for the white (w) toner color. In the image forming device 1, in order to apply the charging voltage CH that is different only for the charging roller 13*w* corresponding to the white (w) color, the charging voltage control part 45 is provided separately from the charging voltage control part 44.

Items of the "supply voltage SB" respectively illustrate bias voltages applied to the supply rollers 17 (17*c*, 17*y*, 17*m*, 17*w*) and the layer forming blades 16 (16*c*, 16*y*, 16*m*, 16*w*). The items of the supply voltage SB in the setting table 351 illustrated in FIG. 5 are set to be −300 V for the toner colors (c, m, y) other than white and −400 V for the white (w) toner color. In the image forming device 1, in order to apply the supply voltage SB that is different only for the supply roller 17*w* and layer forming blade 16*w* corresponding to the white (w) color, the layer formation and supply voltage control part 43 is provided separately from the layer formation and supply voltage control part 42.

Items of the "transfer voltage TR" respectively illustrate bias voltages applied to the transfer rollers 19 (19*c*, 19*y*, 19*m*, 19*w*). The items of the TR in the setting table 351 illustrated in FIG. 5 are set to be +4000 V for all of the toner colors (c, m, y, w).

Items of the "light emission time TL" respectively illustrate light emission times of light emissions (exposures) from the LED heads 14 (14*c*, 14*y*, 14*m*, 14*w*) to the photosensitive drums 12 (12*c*, 12*y*, 12*m*, 12*w*). In FIG. 5, items of LED are illustrated as ratios (%) of increase of decrease with respect to a predetermined reference time. For example, when the above-described reference time is T1 [μS], a parameter value to which the item of the LED is set is k [%], and the light emission time indicated by this parameter is T2 [μs], T2 can be expressed by the following formula (1).

$$T2=T1\times(k/100) \quad (1)$$

In FIG. 5, the light emission times TL of toner colors (c, m, y) other than white are 0% and the light emission time of the white (w) color is −40%. Therefore, in FIG. 5, the light emission time of the white (w) color is set to be a light emission time that is 40% shorter as compared other toner colors (reference time T1).

Items of the "drum surface potential DS1" respectively illustrate values of surface potentials [V] of portions of the photosensitive drums 12 (12*c*, 12*y*, 12*m*, 12*w*) that are not exposed (non-exposure parts OPC). The items of the drum surface potential DS1 in the setting table 351 illustrated in FIG. 5 are set to be −600 V for the toner colors (c, m, y) other than white and −400 V for the white (w) toner color.

Items of the "drum surface potential DS2" respectively illustrate values of potentials [V] of portions of the photosensitive drums 12 (12*c*, 12*y*, 12*m*, 12*w*) that are exposed (exposure parts OPC). The items of the exposure part OPC and the drum surface potential DS2 in the setting table 351 illustrated in FIG. 5 are set to be −50 V for all of the toner colors (c, m, y, w).

In this embodiment, the drum surface potential DS1 is a value based on the charging voltage CH. For example, when the charging voltage CH increases, the charge amount of the charging roller 13 increases and the drum surface potential DS1 also rises. Further, in this embodiment, the drum surface potential DS2 is a value based on the drum surface potential DS1 and the light emission time TL. For example, when the light emission time TL is the same, the higher the drum surface potential DS1 is, the higher the drum surface potential DS2 will be. Further, when the drum surface potential DS1 is the same, the longer the light emission time TL is, the lower the drum surface potential DS2 will be.

Therefore, in the setting table 351 illustrated in FIG. 5, in order to simplify the explanation, the items of the drum surface potentials DS1, DS2 are provided. However, in fact, when the developing voltage DB, the charging voltage CH and the light emission time TL are set, the items of the drum surface potentials DS1, DS2 may be omitted. In other words, in the setting table 351 illustrated in FIG. 5, for each toner color, as parameters for realizing targeted drum surface potentials DS1, DS2, the developing voltage DB, the charging voltage CH and the light emission time TL are set.

In the first embodiment, as a parameter for adjusting an exposure energy amount with respect to the photosensitive drum 12 (exposure part OPC), the light emission time TL is used. However, it also possible to use an output amount of illumination intensity of light emitted from the LED head 14 to adjust the exposure energy amount with respect to the photosensitive drum 12 (exposure part OPC). The larger the exposure energy amount with respect to the photosensitive drum 12 (exposure part OPC) is, the larger the potential difference between the non-exposure part OPC and the exposure part OPC (reduction amount of the potential due to the exposure) will be. Therefore, by adjusting the light emission time and/or output amount of the LED head 14, the potential difference between the non-exposure part OPC and the exposure part OPC can be adjusted.

As described above, in the setting table 351, the parameters of the white (w) toner color and the parameters of the toner colors (c, M, y) other than white are set to different values. As described above, in the first embodiment, only the white (w) toner color has characteristics different from other toner colors, and a risk for "fogging" to occur for the white (w) toner color is high as compared to the other toner colors. Therefore, in the image forming device 1 of the first embodiment, for the white (w) toner color, the setting table 351 as illustrated in FIG. 5 is defined in order to suppress "fogging (or blushing)."

In the present invention, "fogging" refers to a phenomenon in which, for example, excessive toner is attached to an area where image formation is not performed (area where image formation is not planed).

(A-2) Operation of First Embodiment

Figure 6:
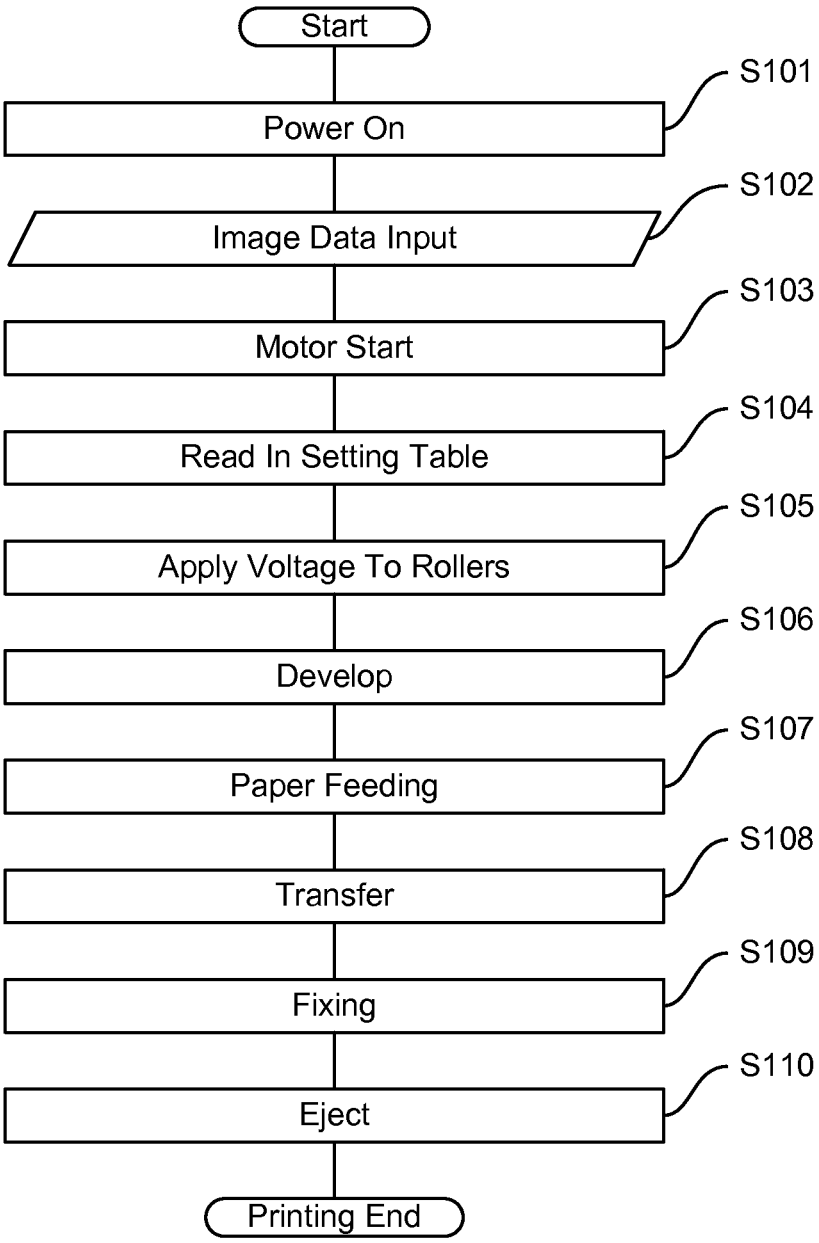
FIG. 6 is a flowchart illustrating an operation of the image forming device according to the first embodiment.

Next, operation of the image forming device 1 of the first embodiment having the configuration as described above is explained using a flowchart of FIG. 6.

Regarding operations of the developing devices 11*c*, 11*y*, 11*m* (developing devices of cyan, yellow and magenta; developing devices of toner colors other than white), the same operations are performed. Therefore, in the following, for some steps, only operations of the developing device 11*c* and the developing device 11*w* are explained. The operations of the other developing devices 11*y*, 11*m* are the same as that of the developing device 11*c* and thus detailed explanation thereof is omitted.

First, image forming device 1 is powered on (S101) and started. Along with the power-on, in the image forming device 1, initialization of the configuration elements, status confirmation and the like are performed by the print control part 30, and the image forming device 1 transitions to a state (online state) capable of receiving print data.

Thereafter, image data for printing is supplied from the higher-level device 31 to the print control part 30 via the interface part 32 (S102). In this case, the print control part 30 temporarily stores the supplied image data in the RAM 36.

Next, the print control part 30 instructs the motor control part 48 to start the motors of the rollers (driving starts), and the rollers begin to rotate (S103). Here, as an example, the motor control part 48 controls the driving motors 25*a*, 25*b* to drive the transfer belt 9 to move at a speed of 130 mm/s along an a2 direction (see FIG. 2), assuming a print speed of 30 PPM. Parameters for such operation of the motor control part 48 may be stored, for example, in the ROM 35.

Next, the print control part 30 reads in the setting table 351 from the ROM 35 (S104).

Next, the print control part 30 controls the voltage control parts (the developing voltage control parts 41, 42, the layer formation and supply voltage control part 43, the charging voltage control parts 44, 45) to apply bias voltages of values according to the setting table 351 (S105).

Next, the print control part 30 controls the configuration elements to develop a toner image based on the image data temporarily stored in the RAM 36 (S106).

As described above, the photosensitive drums 12*c*, 12*w* rotate at a speed of 130 mm/s. Along with the rotation of the photosensitive drums 12*c*, 12*w*, the developing roller 15*c*, 15*w* and the supply roller 17*c*, 17*w* that are engaged with the photosensitive drums 12*c*, 12*w* via gears also rotate.

Further, the supply voltages SB are applied to the layer forming blades 16*c*, 16*w* and the supply roller 17*c*, 17*w* by the layer formation and supply voltage control parts 42, 43. Further, the developing voltages DB according to the setting table 351 are respectively applied to the developing roller 15*c*, 15*w*. Next, the toners Tc, Tw of the toner tanks 18*c*, 18*w* are attached to surfaces of the supply rollers 17*c*, 17*w* to which the supply voltages SB are applied. Next, along with the rotation of the supply rollers 17*c*, 17*w* and the developing rollers 15*c*, 15*w*, the toners attached to the supply rollers 17*c*, 17*w* are supplied to the surfaces of the developing rollers 15*c*, 15*w* due to potential differences between the rollers. Next, along with the rotation of the developing rollers 15*c*, 15*w*, toner layers on surfaces of the developing roller 15*c*, 15*w* are uniformly regulated by shearing forces of the layer forming blade 16*c*, 16*w*, when passing through positions of the layer forming blades 16*c*, 16*w*, and become uniform.

Further, the charging voltages CH are applied to the charging rollers 13*c*, 13*w* by the charging voltage control parts 44, 45 and the charging rollers 13*c*, 13*w* become charged. Next, when the photosensitive drums 12*c*, 12*w* rotate, the surfaces of the photosensitive drums 12*c*, 12*w* are charged by the opposing charging rollers 13*c*, 13*w*.

Further, under the control of the print control part 30, the exposure control parts 46*c*, 46*w* instruct the LED heads 14*c*, 14*w* to perform exposure based on the image data. Next, based on the instructions of the exposure control parts 46*c*, 46*w*, the LED heads 14*c*, 14*w* perform exposure (exposure of patterns based on the image data) on the charged surfaces of the photosensitive drums 12*c*, 12*w*, and electrostatic latent images are formed on the surfaces of the photosensitive drums 12*c*, 12*w*. In this case, the print control part 30 adjusts the light emission time of each of the LED heads 14 according to the content of the setting table 351 (the items of the light emission time TL).

Further, when the surfaces of the developing rollers 15*c*, 15*w*, on which toner layers are formed on the surfaces, and the surfaces of the photosensitive drums 12*c*, 12*w* are in contact with each other, toners of the toner layers are attached to the photosensitive drums 12*c*, 12*w* and electrostatic latent images are developed, and toner images are formed.

As described above, in the image forming device 1, based on the control of the print control part 30, toner images based on the electrostatic latent images are developed on the photosensitive drums 12*c*, 12*w*.

Next, under the control of the print control part 30 (such as control with respect to the motor control part 48), the print medium 23 is fed out from the paper cassette 20 conveyed to a position of the transfer belt 9 (S107).

Next, the transfer voltages TR according to the setting table 351 are applied to the transfer rollers 19*c*, 19*w* by the transfer control part 47, and the toner images on the surfaces of the photosensitive drums 12*c*, 12*w* are transferred to the print medium 23 that is conveyed on the transfer belt 9 (S108).

Next, the print medium 23 on which the toner images have been transferred is conveyed to the fixing unit 24. Then, the toner image of the print medium 23 is subjected to a fixing treatment (heating treatment and pressure treatment) by the fixing unit 24 and is fixed (S109).

In the fixing unit 24, when the fixing treatment is performed, the heating roller 28 is heated by the heating body 28*a* to a predetermined temperature (for example, 60° C.). When the print medium 23 is conveyed in a state being sandwiched between the heating roller 28 that is heated to the predetermined temperature and the pressing roller 29, the toner image on the print medium 23 is heated and pressed and is fixed on the print medium 23.

Next, the print medium 23 that has been subjected to the fixing treatment by the fixing unit 24 is ejected to the output tray 2 by the eject unit 26 (S 110) and one printing process with respect to the print medium 23 is completed.

(A-3) Effects of First Embodiment According to the first embodiment, the following effects can be achieved.

(A-3-1) First, when the charging voltage CH of the charging roller 13 is lowered, the degree of "fogging" that appears as dirt in an area where image formation is not performed on the print medium 23. This is explained using a graph of experimental results illustrated in FIG. 7.

Figure 7:
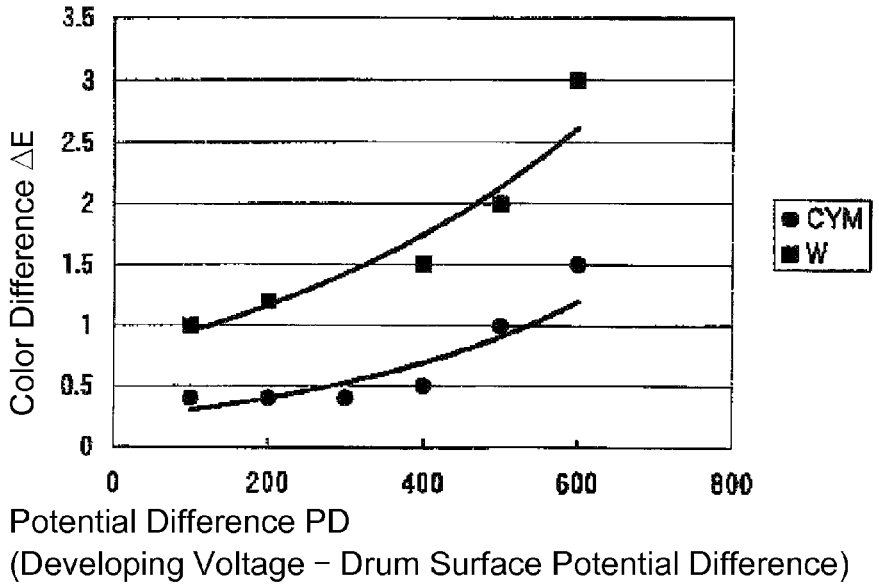
FIG. 7 is a graph illustrating a relation between a potential difference PD and a color difference ΔE in the image forming device according to the first embodiment.

A potential difference PD as a developing potential difference that is indicated on a horizontal axis of the graph of FIG. 7 represents a difference between an absolute value of the developing voltage DB and an absolute value of the drum surface potential DS1.

Figure 8:
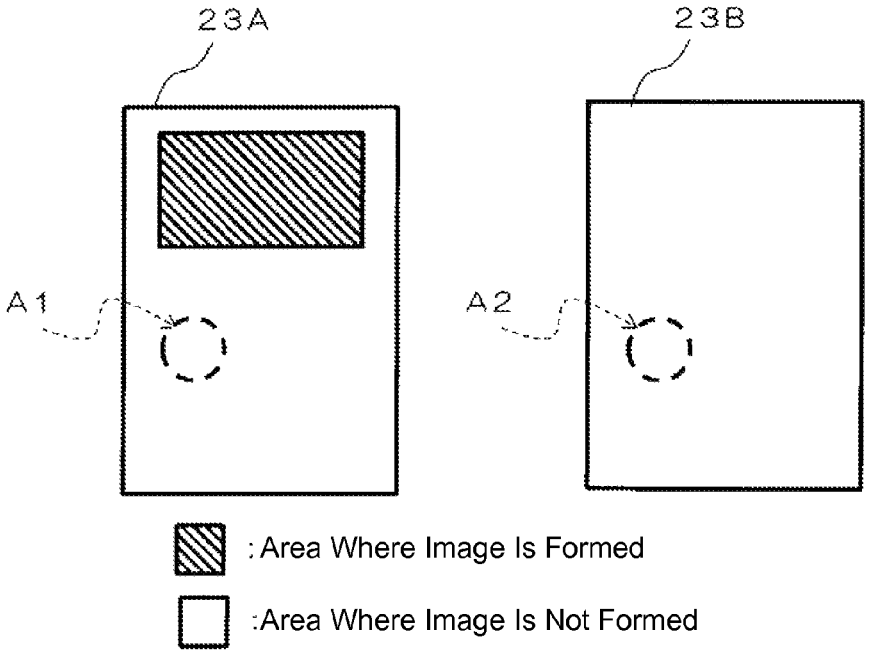
FIG. 8 is an explanatory diagram illustrating a method for measuring a parameter used in calculating the color difference ΔE in the image forming device according to the first embodiment.

Next, color difference ΔE indicated on a vertical axis of the graph of FIG. 7 is explained using FIG. 8.

The color difference ΔE in FIG. 7 represents a difference between results measured by using a spectrophotometer with respect to a sample area A1 (area where image is not formed) of a print medium 23A on which image formation is performed by the image forming device 1 and a sample area A2 (area corresponding to the sample area A1) of a print medium 23B (a print medium on which image formation is not performed) that serves as a reference. In the experiment illustrated in FIG. 7, as the print mediums 23A, 23B, an OHP film CG3700 by Sumitomo 3M is used. Further, on the print medium 23A, the image formation is performed using one developing device 11 (of any one of the toner colors c, m, y, w). Then, values (L*, a*, b*) of an L*a*b* color system are measured using a spectrophotometer CM-2600d by Konica Minolta, Inc., respectively with respect to the sample areas A1, A2 of the print media 23A, 23B. In this case, with respect to a print medium 23A on which an image is formed with the white (w) toner color, the measurement is performed using the spectrophotometer by using a black paper as an underlay. Further, with respect to a print medium 23A on which an image is formed with a toner color (c, m, y) other than white, the measurement is performed using the spectrophotometer by using a white paper as an underlay. Then, the color difference ΔE is obtained by using the following formula (2). In the following formula (2), measurement results of the sample area A1 of the print medium 23A are represented as "L*1, a*1, b*1." Measurement results of the sample area A2 of the print medium 23B are represented as "L*2, a*2, b*2."

$$\text{Color Difference } \Delta E=((L^*1-L^*2)\hat{}2+(a^*1-a^*2)\hat{}2+(b^*1-b^*2)\hat{}2)\hat{}0.5 \quad (2)$$

Therefore, a larger value of the color difference ΔE indicates a larger degree of the "fogging" with respect to the print medium 23A (large degree of poor printing quality).

As described above, the graph of FIG. 7 illustrates the color difference ΔE (vertical axis) when the potential difference PD (horizontal axis) is varied between 100-600 V. In other words, the graph of FIG. 7 illustrates a relation between the potential difference PD and the color difference ΔE for each toner color. FIG. 7 illustrates the color difference ΔE for the case where the image is formed with the white (w) toner color and the color difference ΔE for the case where the image is formed with a toner color (c, y, m) other than white. For toner colors (c, y, m) other than white, the results are the same and thus are represented with the same sample values in FIG. 7.

In the setting table 351 illustrated in FIG. 5, the potential difference PD for toner colors (c, y, m) other than white is 400 V. Therefore, in this case, the color difference ΔE=0.6 from the graph of FIG. 7. Further, in the setting table 351 illustrated in FIG. 5F, the potential difference PD for the white (w) toner color is 200 V, and thus the color difference ΔE=1.2.

Assume a case where the values of the charging voltage CH and the drum surface potential DS1 of the developing device 11*w* of the white (w) toner color are the same as those of the developing devices 11*c*, 11*y*, 11*m* of the other toner colors, that is, a case where the charging voltage CH is set to be −1200 V (the drum surface potential DS1 is set to be −600 V). In this case, since the potential difference PD is 400 V, when this is fitted to the graph of FIG. 7, it gives that the color difference ΔE=1.7. That is, as compared to the state set according to the setting table 351 of FIG. 5, the degree of "fogging" is deteriorated about 40%. As illustrated in FIG. 7, there is a tendency that the smaller the value of the potential difference PD is, the smaller the value of the color difference ΔE will be. In other words, it is clear that, in the image forming device 1, the smaller the value of the potential difference PD is, the smaller the degree of the "fogging" will be.

In general, when the color difference ΔE is equal to or smaller than 1.6, it is a level at which a viewer can slightly feel the difference of the color, and it can be considered as a good printing quality for a printer and the like. Therefore, as illustrated in FIG. 7, in the first embodiment, by lowering the potential difference PD for the white (w) toner color from 400 V to 200 V, the color difference ΔE is improved from 1.7 to 1.2, and a good printing quality can be realized.

As described above, in the first embodiment, the white toner Tw uses metal oxide such as titanium dioxide in the colorant. Therefore, as compared to toners Tc, Tm, Ty of other colors, the white toner Tw has a good conductivity and a property of being difficult to be charged. Usually, charge distribution of a toner spreads like a Gaussian distribution. Therefore, when the potential differences PD are the same, the white toner Tw has a characteristic that the degree of "fogging" becomes larger as compared to the toners Tc, Tm, Ty of other colors. Therefore, in the first embodiment, by reducing the charging voltage CH to reduce the drum surface potential DS1 only for the developing device 11*w* of the white (w) toner color, the degree of "fogging" for the white (w) toner color is reduced.

(A-3-2) As described above, the white toner Tw has a charging ability lower than toners Tc, Tm, Ty of other colors. Therefore, in the image forming device 1, by increasing the supply voltage SB for the white (w) toner color more than other toner colors (c, m, y), the amount of toner attached on the developing roller 15*w* is increased. As a result, in the developing device 11*w*, a Coulomb force between the developing roller 15*w* and the supply roller 17*w* becomes strong, and thus the white toner Tw, even with a low charging ability, can be stably supplied to the developing roller 15*w*. As a result, in the developing device 11*w*, printing at a stable concentration becomes possible.

When the potential difference PD is reduced, there may be a case where it is disadvantageous (printing quality is degraded) in terms of gradation expression. However, the white (w) toner color, for example, as in JP2007-083634A, is often used to print a solid image, for which it is rare that fine gradation expression is required. On the other hand, when printing a solid image, dirt such as "fogging" is easily noticeable and thus significantly affects the printing quality. Therefore, in the image forming device 1, with respect to the white (w) toner color, in order to suppress dirt such as "fogging", even when gradation expression is sacrificed to some extent, its impact on overall quality of the image formation is insignificant.

Further, in the image forming device 1, with respect to the white (w) toner color, by suppressing dirt such as "fogging", consumption of the white toner Tw can also be suppressed.

(A-3-3) In the image forming device 1, as illustrated in FIG. 2, from the upstream side of the medium conveyance, the developing devices 11*c*, 11*y*, 11*m*, 11*w* are sequentially arranged in this order. That is, the developing device 11*w* of the white (w) toner color is positioned at the most downstream side of the medium conveyance. In the image forming device 1, there may be cases where the white toner Tw is superimposed on toners Tc, Tm, Ty of other colors and is transferred. As described above, the toner Tw of the white (w) toner color has the property of being difficult to be charged than toners Tc, Tm, Ty of other colors. Therefore, in the image forming device 1, when the toner Tw of the white (w) toner color is superimposed on toners Tc, Tm, Ty of other colors and is transferred, as compared to a case where toners of the same charging characteristics are superimposed and transferred, an effect of being easily transferred can be achieved.

(B) Second Embodiment

In the following, a second embodiment of an image forming device according to the present invention is explained with reference to the drawings.

(B-1) Configuration of Second Embodiment

A schematic cross-sectional view of an image forming device 1A of a second embodiment can also be illustrated using the above-described FIG. 2.

Figure 9:
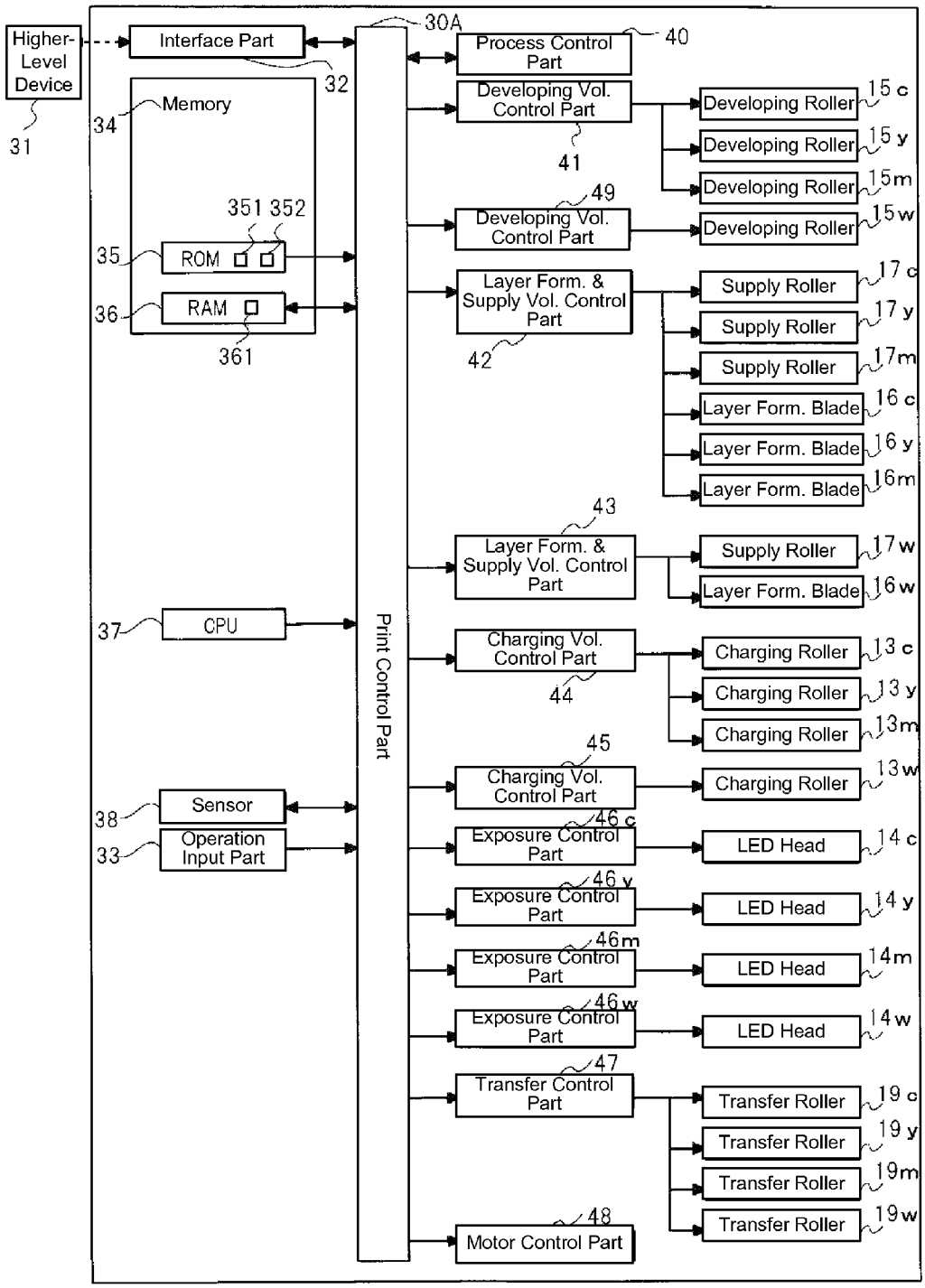
FIG. 9 is a block diagram illustrating a configuration (functional configuration) of a control system of an image forming device according to a second embodiment.

FIG. 9 is a block diagram illustrating a configuration of a control system of the image forming device 1A of the second embodiment. In FIG. 9, a part that is the same as or corresponding to a part in the above-described FIG. 1 is indicated using the same or corresponding reference numeral.

In the following, with respect to the second embodiment, differences as compared to the first embodiment are explained.

The image forming device 1A of the second embodiment is different in that the one developing voltage control part in the first embodiment is separated into two developing voltage control parts 41, 49. As illustrated in FIG. 9, the developing voltage control part 49 applies a developing voltage DB to the developing roller 15*w* of the white (w) toner color. The developing voltage control part 41 applies a developing voltage DB to the developing rollers 15*c*, 15*y*, 15*m* of toner colors (c, m, y) other than white. That is, the second embodiment has a configuration in which different developing voltages DB can be supplied to the developing roller 15*w* of the white (w) toner color and the developing rollers 15*c*, 15*y*, 15*m* of toner colors (c, m, y) other than white.

Further, the second embodiment is different from the first embodiment in that in the ROM 35 of the second embodiment, in addition to a first setting table 351, a second setting table 352 is added.

The print control part 30 of the second embodiment selects a applicable setting table according to the kind of the print medium 23 (the print medium 23 that is supplied to the transfer belt 9) used for image formation. In this embodiment, the print control part 30 controls the voltage control parts using the first setting table 351 when the print medium 23 used for image formation is a plain paper and controls the voltage control parts using the second setting table 352 when the print medium 23 used for image formation is an OHP film. As the OHP film, for example, an OHP film CG3700 by Sumitomo 3M can be used.

A configuration in which the print control part 30 recognizes the kind of the print medium 23 (the print medium 23 that is supplied to the transfer belt 9) used for image formation is not limited. However, in this embodiment, the kind of the print medium 23 used for image formation is determined according to content of operation setting data 361 that is stored in the RAM 36. The operation setting data 361 is flag information indicating the kind of the print medium 23 used for the next image formation. The print control part 30, for example, recognizes that the kind of the print medium 23 used for the next image formation is a "plain paper" when a first value (for example, "0") is set as the operation setting data 361, and recognizes that the kind of the print medium 23 used for the next image formation is an "OHP film" when a second value (for example, "1") is set as the operation setting data 361. The value that is set as the operation setting data 361, for example, may be modified according to a user's operation (for example, an operation with respect to the operation input part 33), and may be also modified based on an instruction from the higher-level device 31. For the operation setting data 361, any value may be set as a default value.

Further, in the image forming device 1A, for example, the kind of the print medium 23 that is supplied to the transfer belt 9 may also be determined using an optical sensor (for example, based on a degree of light transmission).

When an OHP film having a resistance higher than a plain paper is used as the print medium 23, in order to transfer a toner image on the photosensitive drum 12, it is preferable that the transfer voltage TR applied to the transfer roller 19 be larger than that for the plain paper. On the other hand, when the transfer voltage TR is increased, potential of an area on the surface of the photosensitive drum 12 where the print medium does not pass through may decrease and dirt may occur on the print medium 23 (printing quality may deteriorate). Therefore, when the transfer voltage TR is increased, it is desirable that the charging voltage CH be also increased. However, when the charging voltage CH is increased, the potential difference PD increases and, as illustrated in the above-described graph of FIG. 7, the color difference ΔE increases. As a result, the degree of "fogging" also increases (printing quality deteriorates). In particular, printing quality due to the developing device 11*w* of the white (w) toner color that has low charging ability is significantly affected.

Therefore, in the image forming device 1A of the second embodiment, content of the second setting table 352 that is applied when an OHP film is used as the print medium 23 is in FIG. 10. In the second setting table 352, taking the above-described points into consideration, values suitable for the case where an OHP film is used as the print medium 23 are set as values of the parameters.

Specifically, in the second setting table 352, the transfer voltages TR for all toner colors are increased as compared to the case for a plain paper (the first setting table 352) and are set to be +6000 V. Further, in the second setting table 352, in order to suppress deterioration of printing quality, the charging voltages CH for all toner colors are increased as compared to the case for a plain paper (the first setting table 352) and are set to be −1300 V. As a result, when the second setting table 352 is applied, the drum surface potential DS1 of the photosensitive drum 12 for each toner color is lowered and increase in the degree of "fogging" can be suppressed. In the second setting table 352, the charging voltages CH (drum surface potentials DS1) for all the toner colors are set to be the same.

In the second setting table 352, along with increasing the charging voltage CH, in order to adjust the potential difference PD for the white (w) toner color, only the developing voltage DB for the white (w) toner color is increased and is −400 V (the developing voltages DB for other toner colors remain as −200 V).

Further, in the second setting table 352, the light emission times TL for all toner colors are increased by 20% as compared to the first setting table 351. Thereby, the drum surface potentials DS2 (drum surface potentials of non-exposure parts) are adjusted. That is, in the second setting table 352, the potential difference PD for each toner color is the same as that of the first setting table 351. Further, in the second setting table 352, difference between the developing voltage DB and the supply voltage SB for each toner color is also adjusted to be the same as that of the case where the first setting table 351 is applied. Therefore, even in the case where the second setting table 352 is applied, the amount of toner supplied from the supply roller 17 to the developing roller 15 for each toner color is also the same as in the case where the first setting table 351 is applied. Therefore, even in the case where the second setting table 352 is applied, the concentration of the toner used in image formation for each toner color is about the same as in the case where the first setting table 351 is applied.

(B-2) Operation of Second Embodiment

Next, operation of the image forming device 1A of the second embodiment having the configuration as described above is explained using a flowchart of FIG. 11.

First, image forming device 1A is powered on (S201) and started.

Thereafter, print data is supplied from the higher-level device 31 to the print control part 30 via the interface part 32 (S202). In this case, the print control part 30 temporarily stores image data contained in the supplied print data in the RAM 36.

Next, the print control part 30 reads in operation setting data 361 from the RAM 36 and obtains information (a value indicating either a plain paper or an OHP film) about the print medium 23 used for image formation (S203).

Next, the print control part 30 instructs the motor control part 48 to start the motors of the rollers (driving start), and the rollers begin to rotate.

Next, based on the content of the obtained operation setting data 361, the print control part 30 determines the print medium 23 used for image formation (determines whether it is an OHP film) (S205). Next, when the print medium 23 used for image formation is an OHP film, the print control part 30 operates from the processing of S206 (to be described later). On the other hand, when the print medium 23 used for image formation is a plain paper, the print control part 30 operates from the processing of S213 (to be described later).

When the print medium 23 used for image formation is an OHP film, the print control part 30 obtains the second setting table 352 from the RAM 36 (S206).

Next, the print control part 30 controls the voltage control parts to apply bias voltages of voltages according to the second setting table 352 (S207).

Next, the print control part 30 control the configuration elements (for example, the LED head 14 of each toner color, and the like) according to the second setting table 352 to perform development of a toner image, paper-feeding of the print medium 23 (OHP film), transfer of the toner image to the print medium 23 (OHP film), fixing treatment of the toner image to the print medium 23 (OHP film), and eject processing of the print medium 23 (OHP film) (S208-S212). Except that the configuration elements are controlled according to the second setting table 352, S208-S212 are the same as in the operation of the first embodiment (S106-S110) and thus detailed explanation thereof is omitted.

On the other hand, when the print medium 23 used for image formation is a plain paper, the print control part 30 obtains the first setting table 351 from the RAM 36 (S213).

Next, the print control part 30 controls the voltage control parts to apply bias voltages of voltages according to the first setting table 351 (S214).

Next, the print control part 30 control the configuration elements according to the first setting table 351 to perform development of a toner image, paper-feeding of the print medium 23 (plain paper), transfer of the toner image to the print medium 23 (plain paper), fixing treatment of the toner image to the print medium 23 (plain paper), and eject processing of the print medium 23 (plain paper) (S214-S217, S211, S212). S214-S217, S211 and S212 are the same as in the operation of the first embodiment (S106-S110) and thus detailed explanation thereof is omitted.

(B-3) Effects of Second Embodiment

According to the second embodiment, in addition to the effects of the first embodiment, the following effects can be achieved.

In the image forming device 1A, when a print medium having high electrical resistance such as an OHP film is used as the print medium 23, by applying the second setting table 352, deterioration of printing quality is suppressed.

Further, in the second setting table 352, even when the transfer voltage TR is increased, the light emission time TL (exposure energy amount) is adjusted while maintaining the potential difference PD. Therefore, a toner image of a stable concentration having a low degree of "fogging" (good printing quality) can be realized.

(C) Third Embodiment

In the following, a third embodiment of an image forming device according to the present invention is explained with reference to the drawings.

(C-1) Configuration of Third Embodiment

Figure 13:
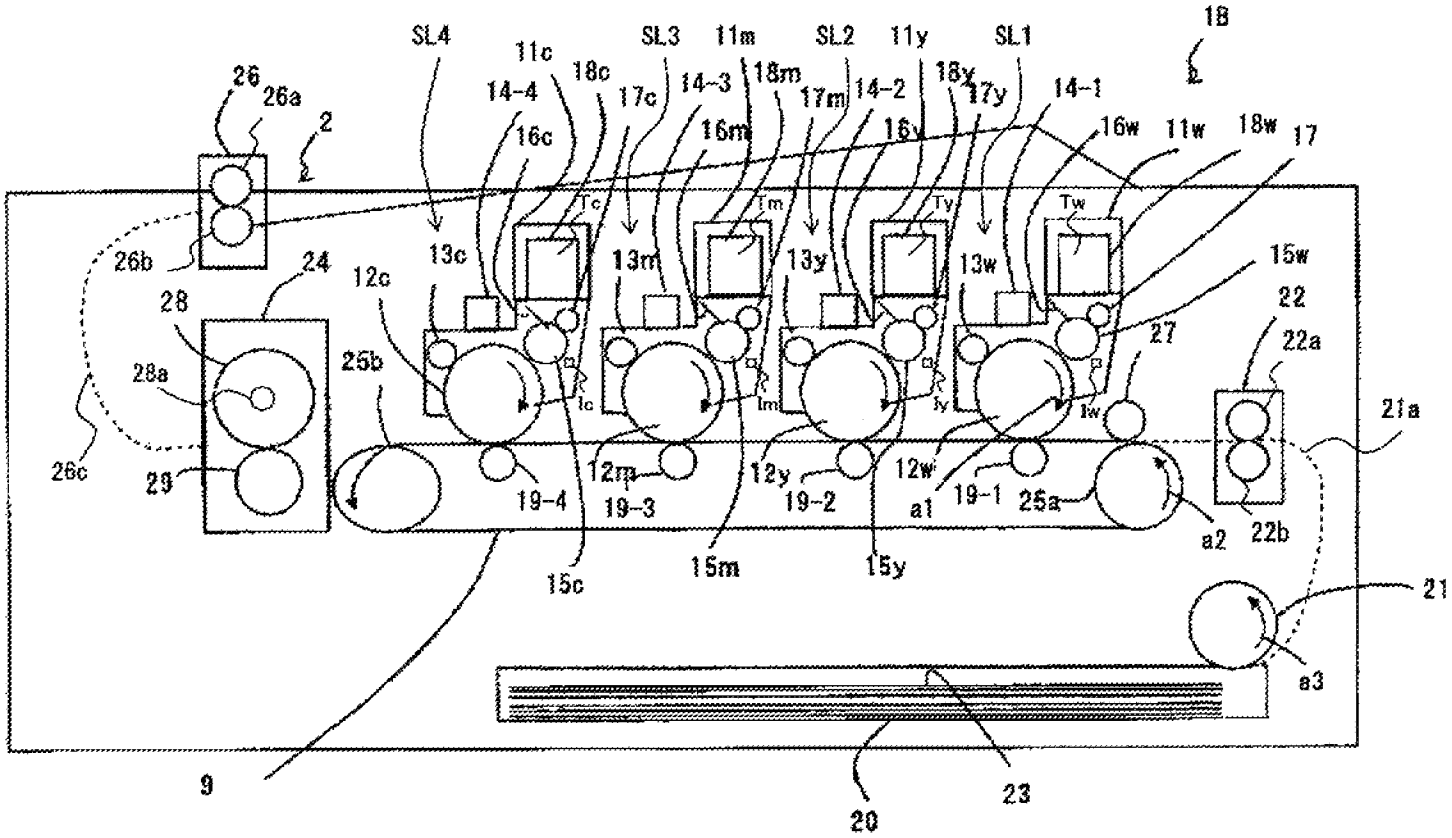
FIG. 13 is a schematic cross-sectional view of the image forming device according to the third embodiment.

A schematic cross-sectional view of an image forming device 1B of a third embodiment can be illustrated using FIG. 13. In FIG. 13, a part that is the same as or corresponding to a part in the above-described FIG. 1 is indicated using the same or corresponding reference numeral.

Figure 12:
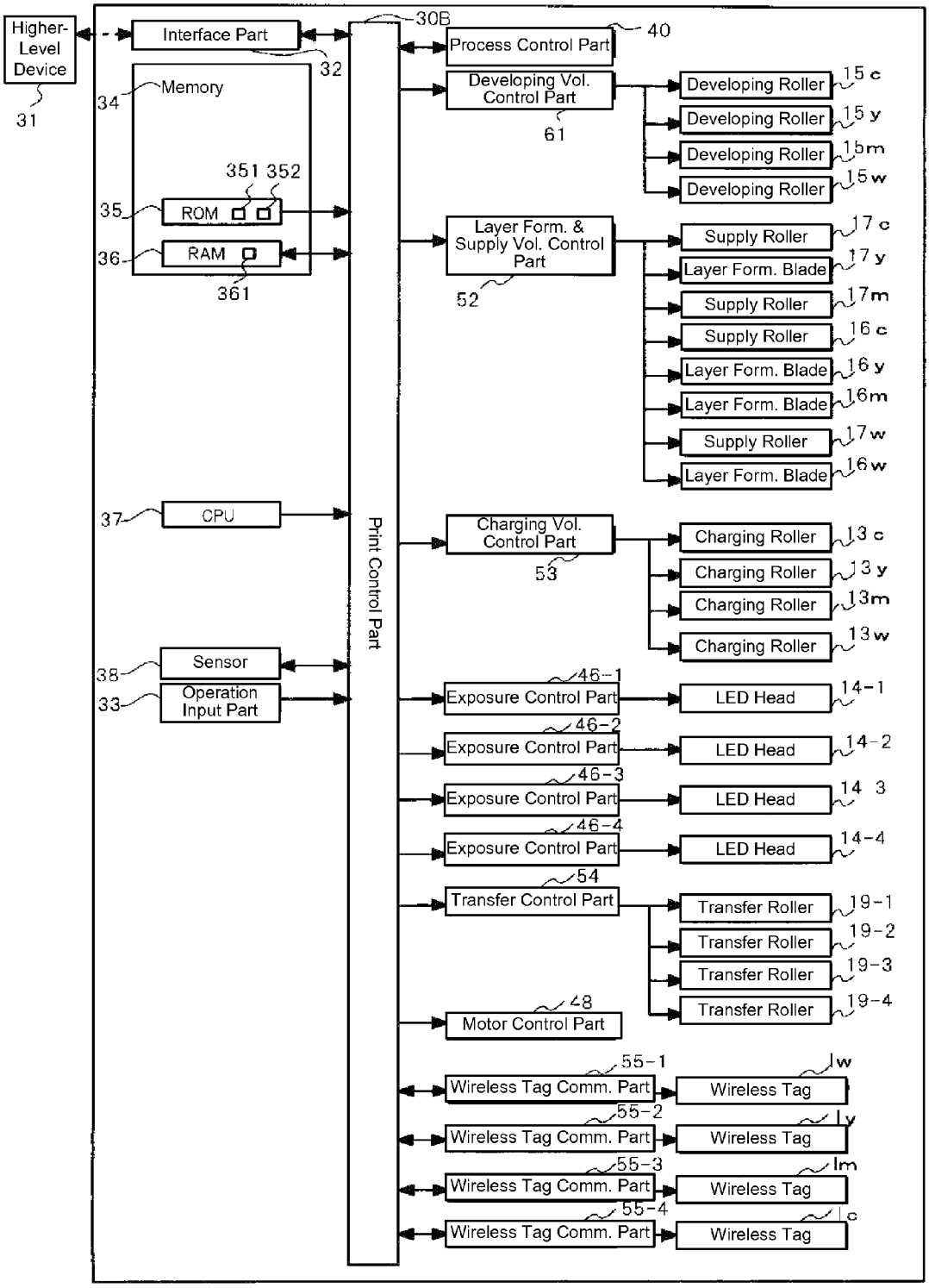
FIG. 12 is a block diagram illustrating a configuration (functional configuration) of a control system of an image forming device according to a third embodiment.

FIG. 12 is a block diagram illustrating a configuration of a control system of the image forming device 1B of the third embodiment. In FIG. 12, a part that is the same as or corresponding to a part in the above-described FIG. 1 is indicated using the same or corresponding reference numeral. In the following, with respect to the third embodiment, differences as compared to the second embodiment are explained.

In the image forming device 1B, four housing parts SL1-SL4 for housing four developing devices 11*c*, 11*y*, 11*m*, 11*w* are provided. The developing devices 11*c*, 11*y*, 11*m*, 11*w* of the toner colors are respectively detachably housed in the housing parts SL1-SL4.

The third embodiment is different from the second embodiment in that, in the image forming device 1B of the third embodiment, the print control part 30A is replaced with a print control part 30B.

In third embodiment, the developing devices 11*c*, 11*y*, 11*m*, 11*w* are respectively arbitrarily housed in the housing parts SL1-SL4 by a user. Therefore, in the print control part 30B, it is necessary to obtain information (such as toner color) about the developing device 11 housed in each of the housing parts SL1-SL4. A configuration in which the print control part 30B obtains information about the developing device 11 housed in each of the housing parts SL1-SL4 is not limited. In this embodiment, as an example, wireless tags I (Ic, Iy, Im, Iw) are respectively attached to the developing devices 11 (11*c*, 11*y*, 11*m*, 11*w*). As the wireless tag I, for example, a wireless tag such as a RFID can be used. Each wireless tag I at least stores information about identification (such as a value of any one of c, y, n, w) indicating a toner color of the developing device 11 on which the wireless tag I is attached, and can transmit the identification information via wireless communication. In the image forming device 1B, wireless tag communication parts 55-1-55-4 are respectively provided for the housing parts SL1-SL4 and can communicate with the wireless tags I of the developing devices 11 housed in the housing parts to obtain the identification information and the like. The print control part 30B can use the wireless tag communication parts 55-1-55-4 to recognize toner colors and the like of the developing devices 11 housed in the housing parts SL1-SL4.

FIGS. 12 and 13 illustrate a state in which the developing devices 11*w*, 11*y*, 11*m*, 11*c* are respectively housed in the housing parts SL1-SL4. As compared ro the above-described FIG. 2, the position of the developing device 11*w* and the position of the developing device 11*c* are switched.

In the image forming device 1B, LED heads 14-1-14-4 are respectively arranged in the housing parts SL1-SL4 for exposing photosensitive drums 12 of the corresponding developing devices 11. Further, in the image forming device 1B, exposure control parts 46-1-46-4 perform exposure control of the LED heads 14-1-14-4. Further, in the image forming device 1B, transfer rollers 19-1-19-4 are respectively arranged below the housing parts SL1-SL4. The configuration of each of the LED head 14, the exposure control part 46 and the transfer roller 19 is the same as in the second embodiment. However, in the third embodiment, each of the LED head 14, the exposure control part 46 and the transfer roller 19 is not used for a particular toner color. Therefore, the reference numerals are changed.

The print control part 30B recognizes the toner color and the like of the developing device 11 housed in each of the housing parts SL1-SL4 and performs control processing in such a manner that each of the developing device 11, the LED head 14 and the transfer roller 19 performs operation corresponding to the recognized toner color.

A developing voltage control part 51 used in the image forming device 1B of the third embodiment can respectively apply individually different developing voltages DB to the developing rollers 15 of the developing devices 11 housed in the housing parts SL1-SL4. The developing voltage control part 51 applies a developing voltage DB based on an instruction from the print control part 30B to each developing roller 15.

A layer formation and supply voltage control part 52 used in the image forming device 1B of the third embodiment can respectively apply individually different supply voltages SB to the supply rollers 17 and the layer forming blades 16 of the developing devices 11 housed in the housing parts SL1-SL4. The layer formation and supply voltage control part 52 applies the supply voltage SB based on an instruction from the print control part 30B to each supply roller 17 and each layer forming blade 16.

A charging voltage control part 53 used in the image forming device 1B of the third embodiment can respectively apply individually different charging voltages CH to the charging rollers 13 of the developing devices 11 housed in the housing parts SL1-SL4. The charging voltage control part 53 applies a charging voltage CH based on an instruction from the print control part 30B to each charging roller 13.

A transfer control part 54 used in the image forming device 1B of the third embodiment can respectively apply individually different transfer voltages TR to the transfer roller 19-1-19-4 that respectively correspond to the housing parts SL1-SL4. The transfer control part 54 applies a transfer voltage TR based on an instruction from the print control part 30B to each transfer roller 19.

The print control part 30B recognizes identification information (toner color) of each of the developing devices 11 house in the housing parts SL1-SL4 and, based on the recognition result, instructs the developing voltage control part 51, the layer formation and supply voltage control part 52, the charging voltage control part 53 and the transfer control part 54 regarding bias voltages (developing voltage DB, charging voltage CH, supply voltage SB, and transfer voltage TR) for each of the developing devices 11. Further, based on the recognition result, the print control part 30 instructs the exposure control parts 46-1-46-4 regarding data of an electrostatic latent image used for image formation, light emission times TL and the like.

(C-2) Operation of Third Embodiment

Figure 11:
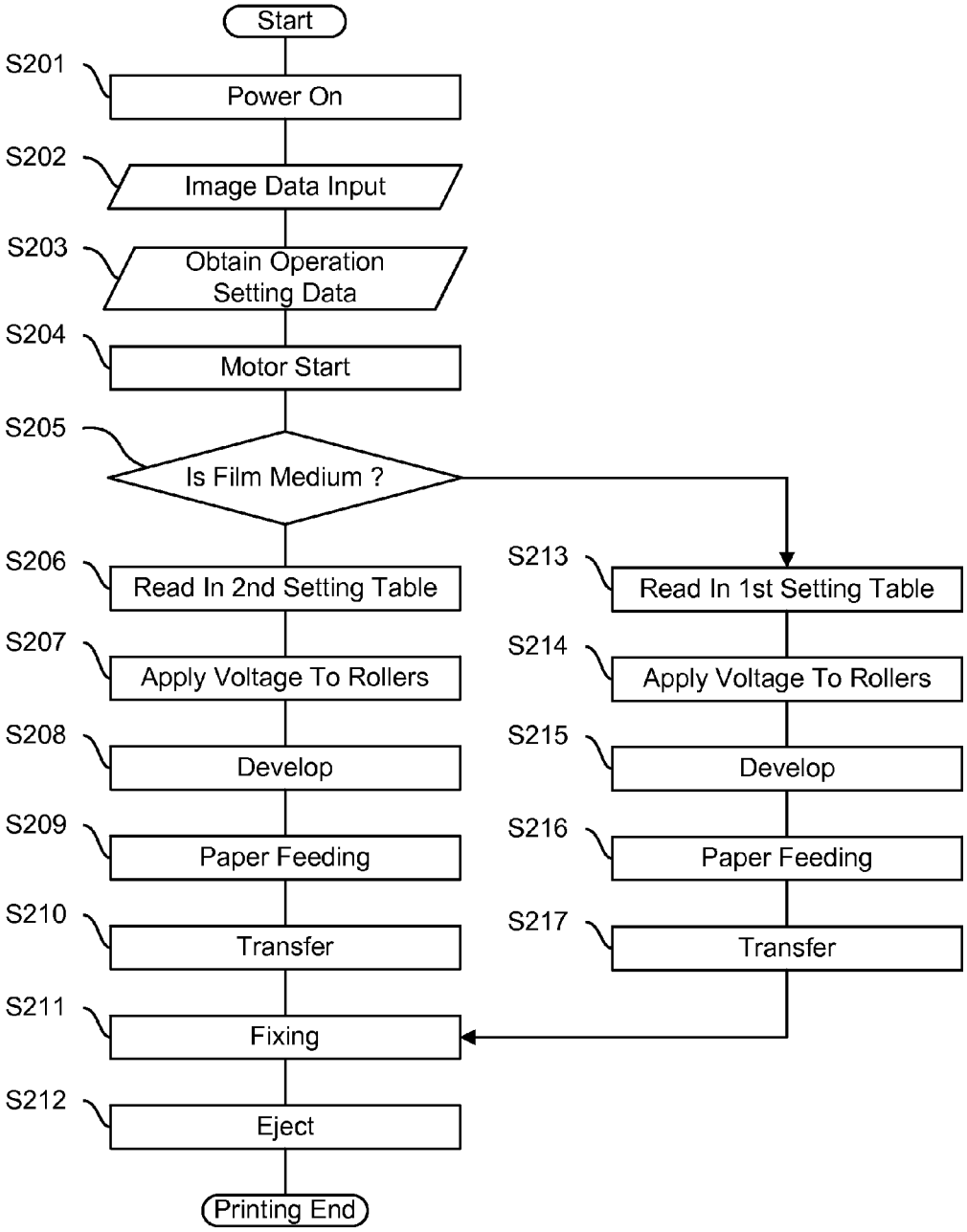
FIG. 11 is a flowchart illustrating an operation of the image forming device according to the second embodiment.
Figure 14:
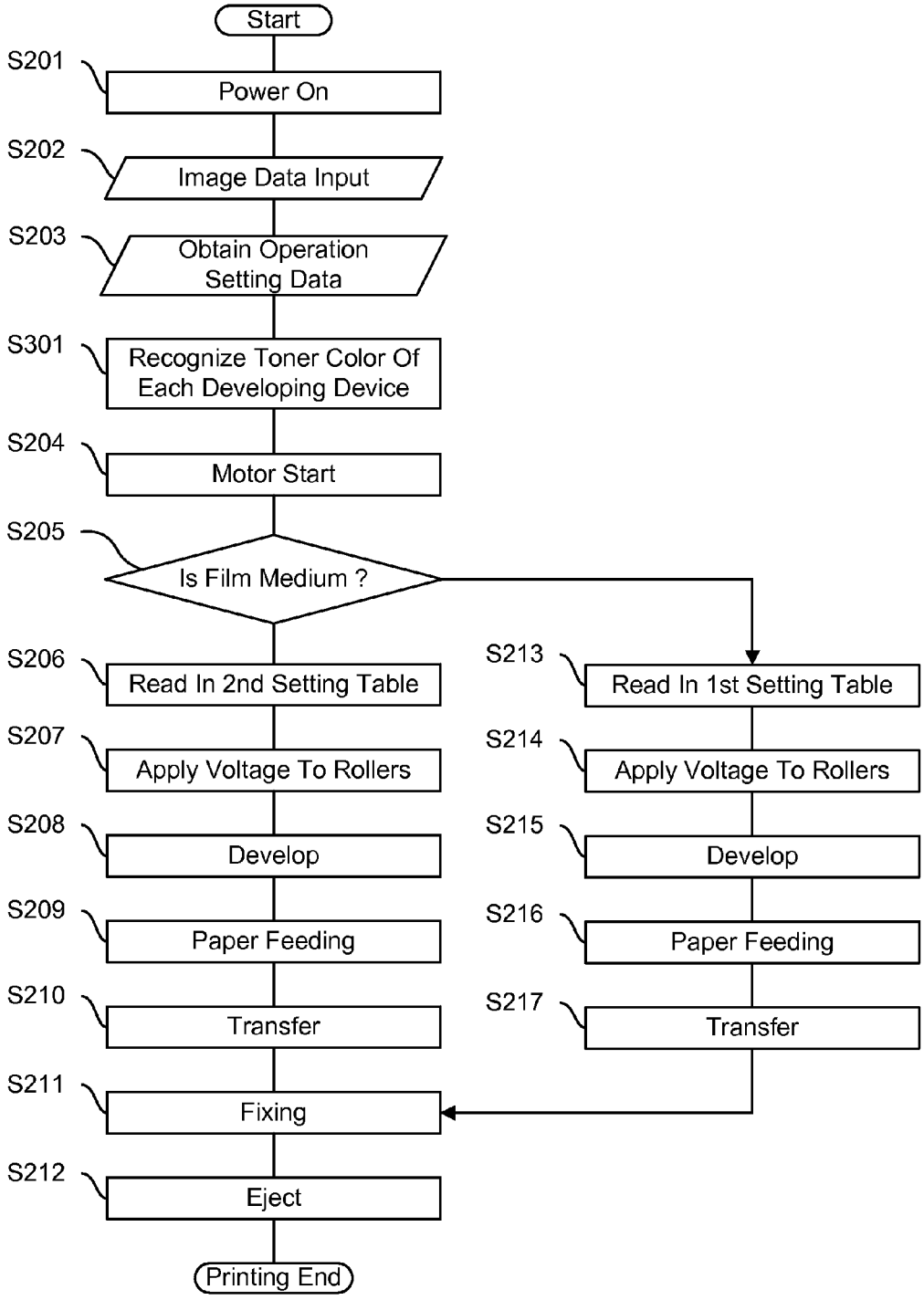
FIG. 14 is a flowchart illustrating an operation of the image forming device according to the third embodiment.

Next, operation of the image forming device 1B of the third embodiment having the configuration as described above is explained using a flowchart of FIG. 14. In FIG. 14, a step performing the same processing as in the above-described FIG. 11 is indicated using the same reference numeral.

The third embodiment is different from the second embodiment in that operation of S301 is inserted in the third embodiment.

At S301, the print control part 30B uses the wireless tag communication parts 55-1-55-4 to recognize toner colors of the developing devices 11 housed in the housing parts SL1-SL4.

Processing of other steps is the same as in the second embodiment except that the print control part 30B controls the developing voltage control part 51, the layer formation and supply voltage control part 52, the charging voltage control part 53, the transfer control part 54 and the exposure control parts 46-1-46-4, based on the recognition result of S301. Therefore, detailed explanation of the processing of the other steps is omitted.

(C-3) Effects of Third Embodiment

In the third embodiment, in addition to the effects of the second embodiment, the following effects can be achieved.

In the print control part 30B of the third embodiment, even when a developing device 11 of any toner color is housed in any one of housing parts SL by a user, the same effect as the second embodiment can be achieved. For example, in a case where a plurality of toner colors are to be superimposed for printing (for example, a case where white toner is used as a base and toners of other toner colors are superimposed thereon), it can be realized by housing the developing device 11 of the toner color of a bottom layer in the housing part SL1 and housing the developing device 11 of the toner color of a top layer in the housing part SL4.

(D) Other Embodiments

The present invention is not limited to the above-described embodiments, but can also include modified embodiments as exemplified in the following.

(D-1) In the third embodiment, it is described that a configuration, in which a developing device of any toner color can be housed at any position (housing part), is added to the image forming device of the second embodiment. However, the same configuration may also be added to the image forming device of the first embodiment.

Further, in the first and second embodiments, the housing position of each developing device, the number of housed developing devices and the types and combinations of the toner colors that are applied are not limited.

Figure 15:
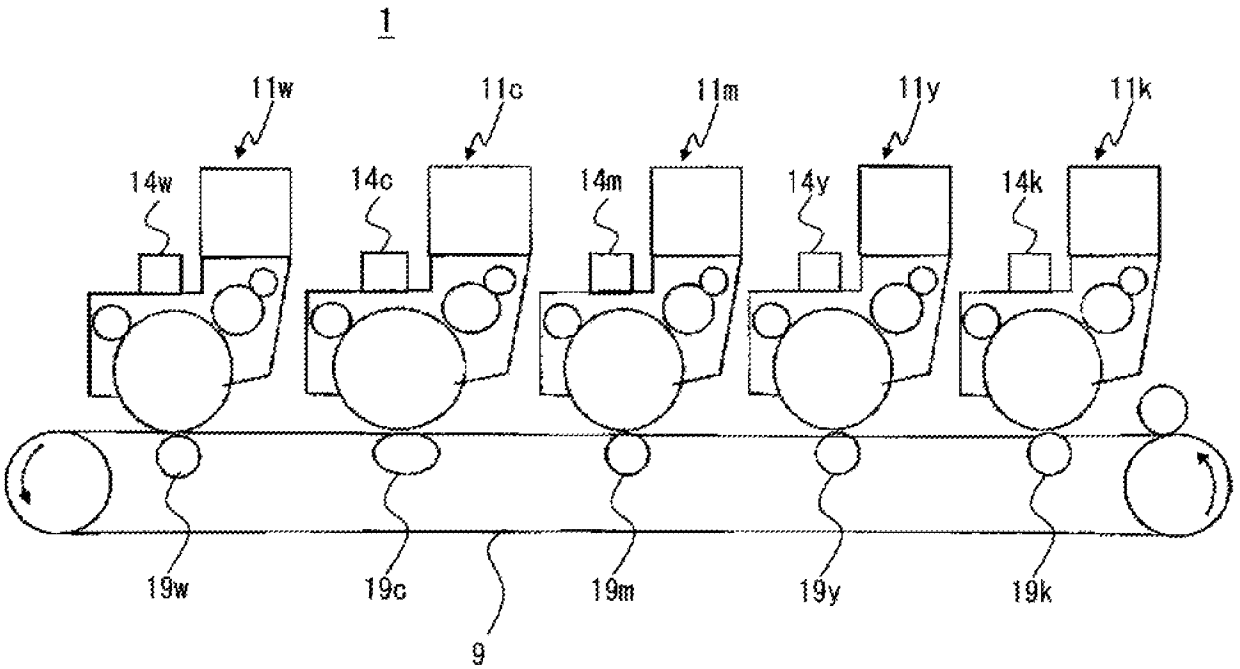
FIG. 15 is a schematic cross-sectional view of an image forming device according to modified embodiment.

For example, as illustrated in FIG. 15, a developing device 11*k*, an LED head 14*k* and a transfer roller 19*k* that correspond to a toner color of black (indicated as "k" in FIG. 5) may also be added to the image forming device of the first embodiment.

Further, for example, the image forming device of the second embodiment may also be configured as an image forming device capable of housing only one developing device (for example, an image forming device capable of image formation using only one color among a plurality of toner colors including white).

(D-2) In the above-described embodiments, an example is explained in which the image forming device of the present invention is applied to an image forming device of a tandem system. However, the image forming device of the present invention may also be applied to an image forming device of a four-cycle system in which one photosensitive drum is shared by a plurality of toner colors. Further, in the above-described embodiments, an example is explained in which the image forming device of the present invention is applied to an image forming device of a direct-transfer system (a system in which a toner image is directly transferred from a photosensitive drum to a print medium). However, the image forming device of the present invention may also be applied to an image forming device of an intermediate belt transfer system (a system in which a toner image is transferred to a print medium via an intermediate transfer belt).

Further, in the above-described embodiments, an example is explained in which the image forming device of the present invention is applied to a printer. However, the device to which the image forming device of the present invention is applied is not limited to this. For example, the image forming device of the present invention may also be applied to various image forming devices such as a color copier and a facsimile apparatus.

What is claimed is:

1. An image forming device comprising:

a plurality of developing devices, each of which includes an image carrying part that carries an electrostatic latent image, a charging part that charges the image carrying part, a developing part on which a developing voltage is applied and which attaches developer to the image carrying part to develop the electrostatic latent image so that a developer image is created, and a control part that controls each of the developing devices, wherein the developers are a white developer and other color developers, one of the developing devices using the white developer being defined the white developing device, the others using the other color developers being defined the non-white developing devices, and a developing potential difference of the white developing device is smaller than other developing potential differences of the non-white developing devices, the developing potential difference being defined between the developing voltage and potential of the image carrying part of the each developing device.

2. The image forming device according to claim 1 wherein the white developer contains metal oxide.

3. The image forming device according to claim 2 wherein the metal oxide is titanium oxide.

4. The image forming device according to claim 1, further comprising:

a developing bias application part that applies the developing voltage to the developing part of each of the developing devices; and a charging bias application part that applies a charging bias voltage to the charging part of each of the developing devices, wherein the control part controls the developing bias application part and the charging bias application part differently according to a type of the developer used in the developing device.

5. The image forming device according to claim 4, wherein the control part controls in such a manner that an absolute value of the charging bias voltage of the white developing device is smaller than that of the charging bias voltage of the non-white developing device.

6. The image forming device according to claim 4, wherein the control part controls in such a manner that an absolute value of the developing bias voltage of the white developing device is larger than that of the developing bias voltage of the non-white developing device.

7. The image forming device according to claim 4, wherein the developing voltage for the white developing device is smaller than that for the non-white developing devices so that fogging of the developer images on the medium is prevented.

8. The image forming device according to claim 1, wherein the white developer has a charging ability lower than the other color developers have.

9. The image forming device according to claim 1, further comprising:

a transfer part that transfers the developer image developed at the image carrying part of the developing device to a medium; and a transfer bias application part that applies a transfer bias voltage to the transfer part, wherein the control part controls the transfer bias voltage applied by the transfer bias application part.

10. The image forming device according to claim 9, wherein the transfer part superimposes and forms one developer image with the white developer and the other developer image with the non-white developer on the same side of the medium.

11. The image forming device according to claim 9, wherein each of the image carrying parts has the transfer part.

12. The image forming device according to claim 1, further comprising:

an exposure part that is provided corresponding to each of the image carrying parts and exposes the image carrying part to form the electrostatic latent image; and an exposure control part that controls exposure energy of the exposure part for exposing the image carrying part.

13. The image forming device according to claim 1, wherein potential of a surface of the developing device for the white developing device is smaller than those for the non-white developing devices so that fogging of the developer images on the medium is prevented.

* * * * *